US006814093B2

(12) United States Patent
You

(10) Patent No.: US 6,814,093 B2
(45) Date of Patent: Nov. 9, 2004

(54) AUTO-OPENING UMBRELLA WITH ENHANCED SPREADERS

(76) Inventor: Ching-Chuan You, c/o Percy International Patent Corp., P.O. Box 1-79, Taipei (TW)

( * ) Notice: Subject to any disclaimer, the term of this patent is extended or adjusted under 35 U.S.C. 154(b) by 0 days.

(21) Appl. No.: 10/172,049

(22) Filed: Jun. 17, 2002

(65) Prior Publication Data

US 2003/0188773 A1 Oct. 9, 2003

(30) Foreign Application Priority Data

Apr. 8, 2002 (TW) ..... 91204519 U

(51) Int. Cl.[7] ..... A45B 25/14

(52) U.S. Cl. ..... 135/23; 135/27; 135/29; 135/31; 211/197

(58) Field of Search ..... 135/22, 23, 25.32, 135/27, 29, 31, 32, 40; 211/195, 197

(56) References Cited

U.S. PATENT DOCUMENTS

| | | | | | |
|---|---|---|---|---|---|
| 2,877,782 | A | * | 3/1959 | Zimmermann | 135/23 |
| 3,658,076 | A | * | 4/1972 | Yasuda | 135/22 |
| 5,050,627 | A | * | 9/1991 | Hengtzu | 135/23 |
| 5,226,438 | A | * | 7/1993 | Dubinsky | 135/33.4 |
| 6,095,169 | A | * | 8/2000 | Lin et al. | 135/31 |
| 6,158,452 | A | * | 12/2000 | You | 135/26 |
| 6,345,637 | B1 | * | 2/2002 | Ko | 135/22 |
| 6,374,840 | B1 | * | 4/2002 | Ma | 135/22 |

FOREIGN PATENT DOCUMENTS

| | | | |
|---|---|---|---|
| JP | 52-39454 | * | 3/1977 |
| JP | 8-70919 | * | 3/1996 |
| JP | 8-80206 | * | 3/1996 |
| JP | 8-173223 | * | 7/1996 |

* cited by examiner

*Primary Examiner*—Winnie Yip
(74) *Attorney, Agent, or Firm*—Dennison, Schultz, Dougherty & MacDonald

(57) ABSTRACT

An enhanced frame of an auto-opening umbrella comprises hollow cylindrical intermediate joints with spreaders passed through and each including two spaced bottom lugs, a bar across the lugs, and a recess between the lugs. The bar is disposed less than half of a projected distance of the lug. A plurality of links has hooked ends pivotably coupled to a lower ring and the bar. Also, the recess is in communication with a hole of the joint. The outer hooked end of each link is sufficiently smaller than the recess so that ribs are spaced apart from the spreaders by a much smaller distance when the umbrella is folded. This can achieve a smooth folding operation and a more compact umbrella after folded.

2 Claims, 5 Drawing Sheets

AUTO-OPENING UMBRELLA WITH ENHANCED SPREADERS

BACKGROUND OF THE INVENTION

1. Field of the Invention

The present invention relates to umbrellas and more particularly to an auto-opening umbrella in which the operation is smooth when the umbrella is opened and folded and the umbrella can be stored more compactly when it is folded.

2. Description of Related Art

Auto-opening umbrellas are well known. One type of such umbrella is disclosed in U.S. Pat. No. 6,158,452 as shown in FIGS. 6 and 7. It is characterized by the provision of a main shaft A, a bottom running hub D, an intermediate running hub D1, a spiral spring F disposed between the running hubs D and D1, a radiating frame of ribs M (only one is shown), a frame of supporting ribs S (only one is shown), and a frame of linkage beams E (only one is shown). It is known that the auto-opening force is provided by the compressed spring F. Hence, the spring F, the supporting ribs S, and the second pivotal coupling devices P are critical to the operation of the auto-opening umbrella. In the identified patent, the second pivotal coupling devices P are formed by plastic injection molding. A coupling hole H is extended parallel to the second pivotal coupling device P. An upper end E1 of linkage beam E is shaped like a hook. Also, an arcuate trace is formed as the upper hook E1 is pivoted in the coupling hole H in opening the umbrella. However, such pivoting operation is not smooth when the spring F is expanded. This is because a diameter of the coupling hole H is only slightly larger than that of the upper end E1, i.e., very small allowance. Moreover, an assembly of the umbrella is time consuming, resulting in an increase in the manufacturing cost.

Another auto-opening umbrella formed of FRP (Fiber Reinforced Plastics) is shown in FIG. 8 in which a linking block T is extended a distance from the second pivotal coupling device P on the supporting rib S and perpendicular thereto for effecting a pivot relative to an FRP linkage beam C. Thus, the linkage beam C can be pivotal about the second pivotal coupling device P and the bottom running hub D by pivotably connecting upper and lower joint C1 and C2 to the linking block T and the bottom running hub D respectively. However, such construction makes the FRP umbrella frame unacceptable large after folded since the ribs M are spaced apart from the second pivotal coupling devices P by a distance substantially as the width of the linking block T. As such, the umbrella is disadvantageous in consideration of storage, packing, and transportation.

Thus, it is desirable to provide an improved auto-opening umbrella in order to overcome the above drawbacks of prior art.

SUMMARY OF THE INVENTION

It is an object of the present invention to provide an enhanced frame of an auto-opening umbrella which is more compact after being folded.

It is another object of the present invention to provide an enhanced frame of an auto-opening umbrella which is very smooth in an folding and opening operation.

To achieve the above and other objects, the present invention provides a frame of an auto-opening umbrella comprising a shank including a slidable lower ring, a slidable intermediate ring both thereon, a stationary upper hub, and an elastic means biased between the intermediate and the lower rings; a rib assembly including a plurality of ribs; a spreader assembly including a plurality of spreaders, each of them being pivotably coupled to each of both the ribs and the intermediate ring; a plurality of links having an inner hooked end and an outer hooked end wherein each of the inner hooked ends is pivotably coupled to the lower ring; and a plurality of substantially hollow cylindrical intermediate joints each including a central through hole with the spreader passed through and fastened therein, two spaced downward extending bottom lugs, a bar being across the lugs; wherein the outer hooked end of each link is pivotably coupled to the bar. In one aspect of the present invention, the bar is disposed at a position less than half of a projected distance of the lug relative to a bottom of the intermediate joint.

In another aspect of the present invention, the link is made of stainless steel.

In still another aspect of the present invention, the outer hooked end of each link is disposed around more than half of a circumference of the bar.

In a further aspect of the present invention, the recess is in communication with the central through hole and the outer hooked end of each link is sufficiently smaller than the recess so that the ribs are spaced apart from the spreaders by a substantially zero distance when the umbrella is folded.

The above and other objects, features and advantages of the present invention will become apparent from the following detailed description taken with

DETAILED DESCRIPTION OF THE PREFERRED EMBODIMENTS

Figure 2:
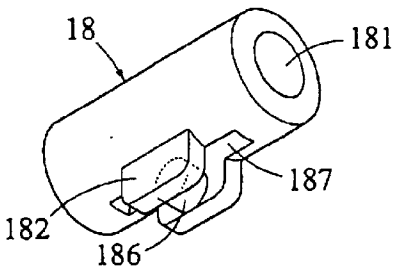
FIG. 2 is a perspective view of an intermediate joint of FIG. 1.
Figure 1:
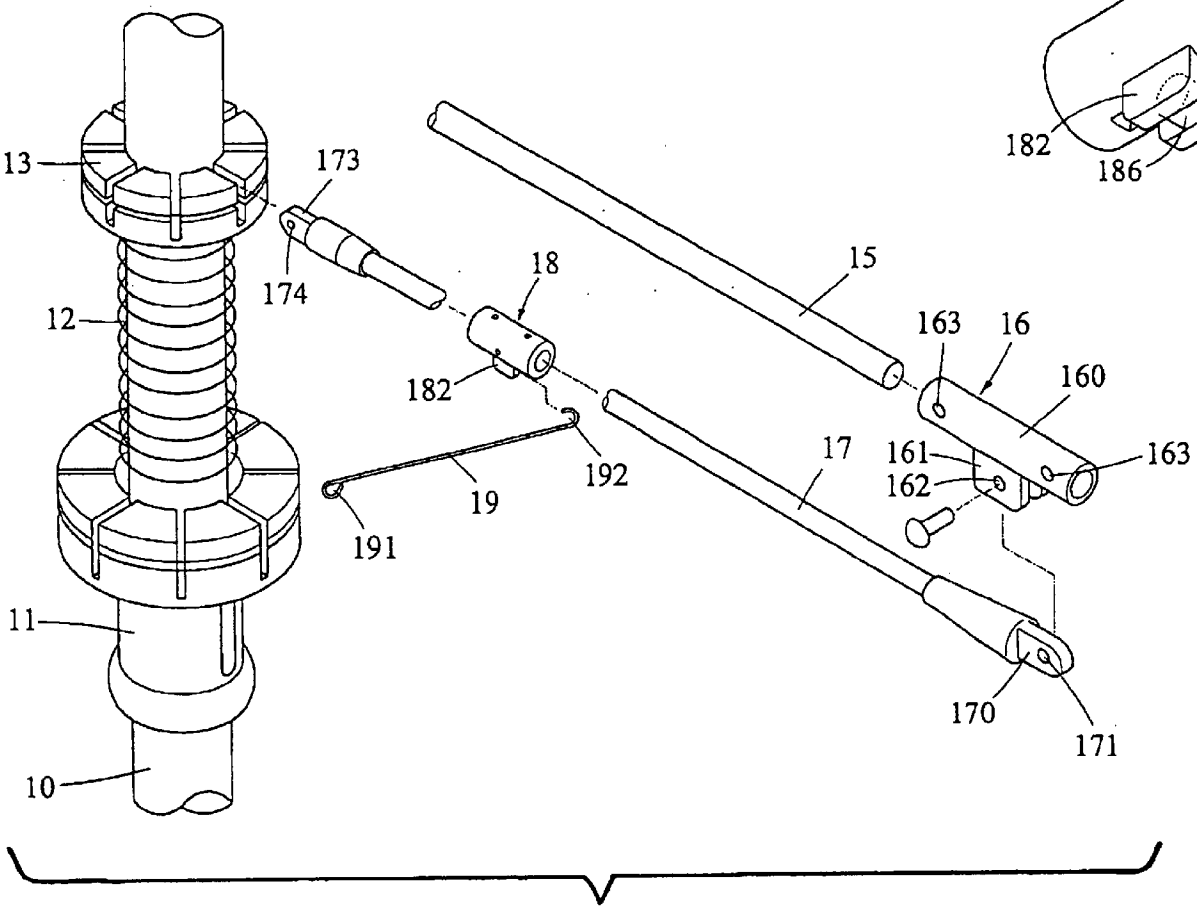
FIG. 1 is an exploded perspective view of a preferred embodiment of auto-opening umbrella according to the invention.

Referring to FIGS. 1 to 5, there is shown an auto-opening umbrella frame constructed in accordance with the invention. The frame comprises a shank 10, a plurality of links 19 formed of stainless steel, a plurality of ribs 15, and a plurality of spreaders 17 both formed of FRP bar for reducing weight and keeping from rust. Also, the number of links 19, ribs 15, and spreaders 17 are equal. Shank 10 comprises a slidable lower ring 11, a slidable intermediate ring 13 both mounted thereon, a stationary upper hub (not shown), and a spring (e.g., coil spring) 12 biased between the intermediate and the lower rings 11 and 13. An equal number of latches 16 are sleeved on the ribs 15 and pivotably coupled to the spreaders 17. Latches 16 are formed of plastic (e.g., nylon) injection molding. Note that such connection is well known. Thus a detailed description thereof is omitted herein for the sake of brevity.

Link 19 is shaped to have two hooked ends 191 and 192 wherein the inner hooked end 191 is pivotably coupled to the lower ring 11 in a well known manner. Thus a detailed description thereof is omitted herein. Spreader 17 comprises an outer end piece 170 having hole 171 pivotably coupled to the rib 15 and an inner end piece 173 having hole 174 pivotably coupled to the intermediate ring 13. Such connection is also well known. Thus a detailed description thereof is omitted herein. The characteristics of the invention are further detailed below. A substantially hollow cylindrical intermediate joint 18 comprises a central through hole 181 with the spreader 17 passed through, two apertures 184 for permitting an adhesive or any of other bonding materials to fill into for securing the intermediate joint 18 to the spreader 17, two spaced bottom lugs 182, a bar 186 across the lugs 182, and a recess 187 between the lugs 182 in communication with the hole 181, the recess 187 having a length longer than that of each lug 182.

Figures 3, 4:
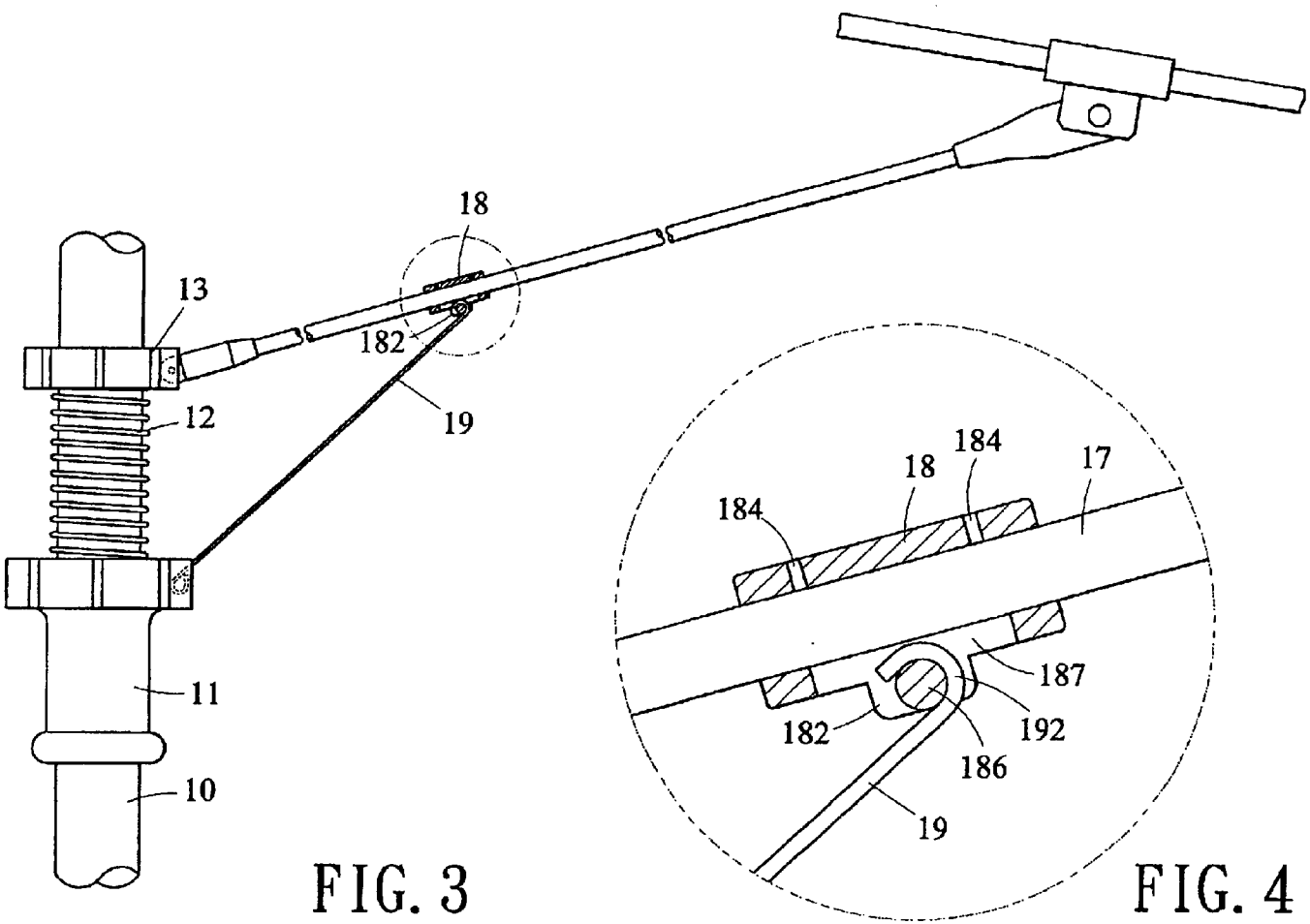
FIG. 3 is a side view of a portion of the umbrella frame which is in an open state.
FIG. 4 is a greatly enlarged fragmentary view of a circle shown in FIG. 3 for detailing a pivotal relationship between a link and the intermediate joint which is sleeved on a spreader.
Figure 5:
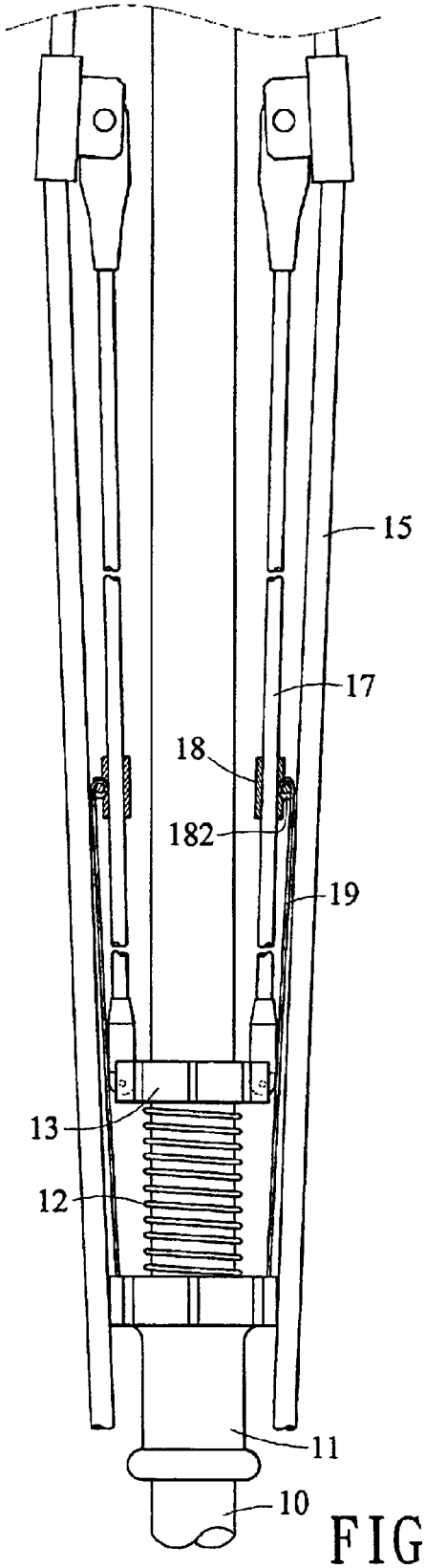
FIG. 5 is side view of the umbrella in a folded state.
Figure 6:
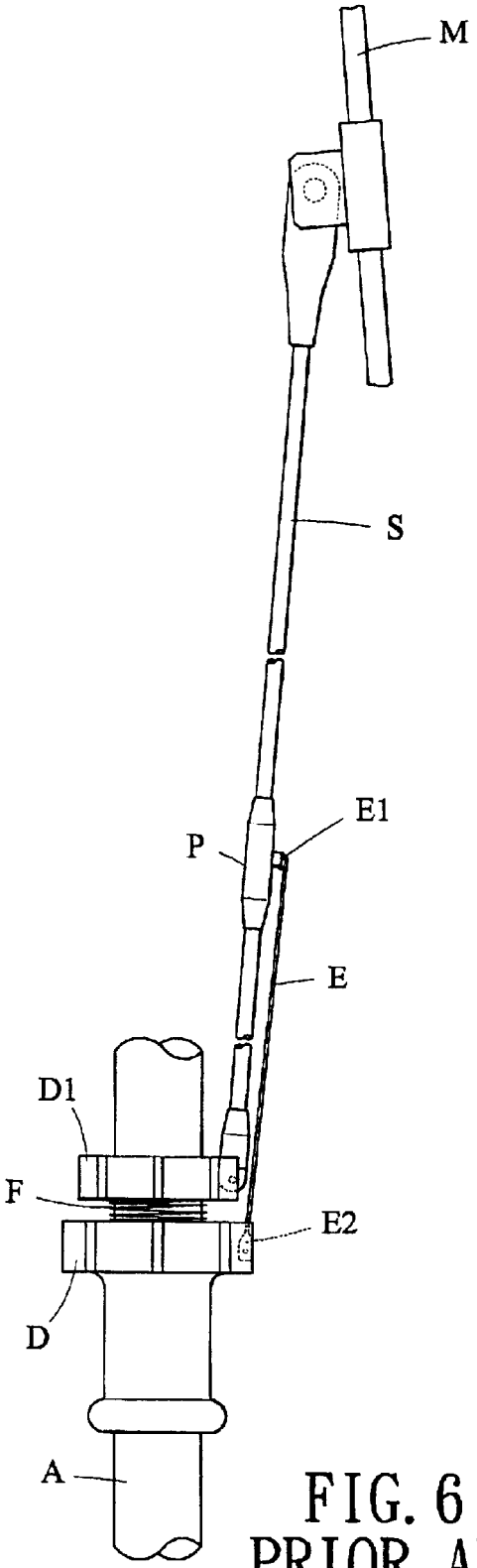
FIG. 6 PRIOR ART
FIG. 6 is a front view of a foldable frame structure of an umbrella according to prior art when the umbrella is folded.
Figure 7:
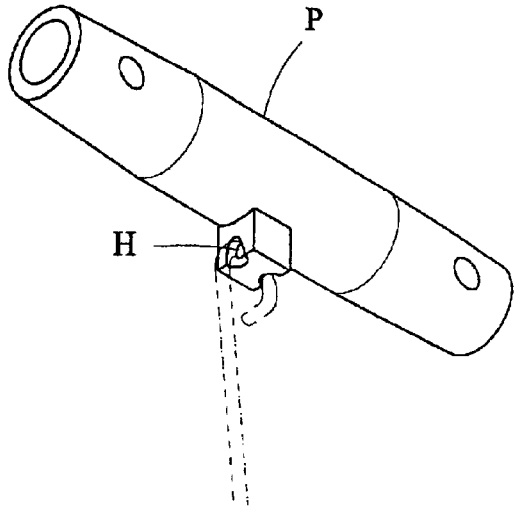
FIG. 7 PRIOR ART
FIG. 7 is a partial view of a second pivotal coupling device shown in FIG. 6.
Figure 8:
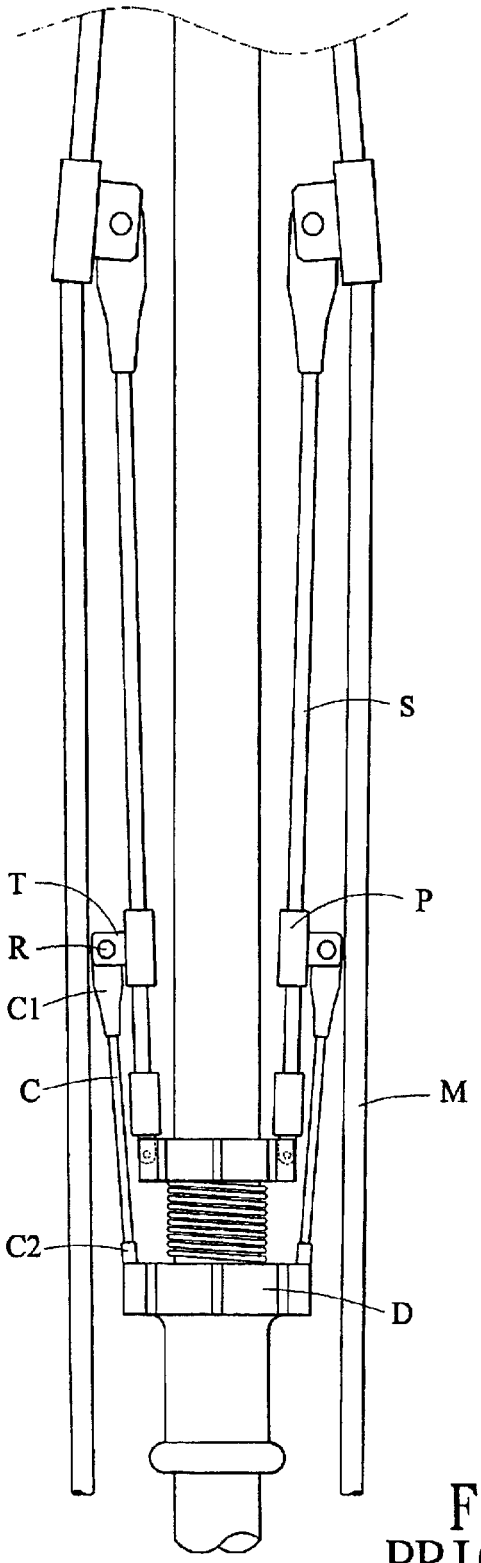
FIG. 8 PRIOR ART
FIG. 8 is side view of another foldable umbrella according to prior art in a folded state.

Moreover, the outer hooked end 192 of link 19 is disposed around more than half of the circumference of the bar 186 (see FIG. 4). This has an advantage of effecting a smooth operation of the link 19 relative to the intermediate joint 18 when the spring 12 is expanded for opening the umbrella. The smooth operation is made possible because an allowance of the outer hooked end 192 in the recess 187 is relatively large, i.e., the outer hooked end 192 is sufficiently smaller than the recess 187. The invention further includes a benefit of being more compact in a storage state. This is best illustrated in FIGS. 4 and 5. In FIG. 4, the bar 186 is made as close to the outer surface of the intermediate joint 18 as possible (e.g., less than half of the projected distance of the lug 182). Also, the projected distance of each lug 182 is made as small as possible. Further, as stated above, the recess 187 is made in communication with the hole 181. As shown in FIG. 5, the ribs 15 are spaced apart from the spreaders 17 by a distance much smaller than that of prior art in an storage state of the umbrella. As such, the umbrella is advantageous in consideration of storage, packing, and transportation.

While the invention herein disclosed has been described by means of specific embodiments, numerous modifications and variations could be made thereto by those skilled in the art without departing from the scope and spirit of the invention set forth in the claims.

What is claimed is:

1. A frame of an auto-opening umbrella comprising;

a shank including a slidable lower ring and a slidable intermediate ring slidably mounted thereon, and an elastic means biased between the intermediate and the lower rings;

a rib assembly including a plurality or ribs;

a spreader assembly including a plurality of spreaders, each of them being pivotably coupled to each of said plurality of ribs and the intermediate ring;

a plurality of links having an inner hooked end and an outer hooked end wherein each of the inner hooked ends is pivotably coupled to the lower ring; and a plurality of substantially hollow cylindrical intermediate joints each including a central through hole with the spreader passed through and fastened therein, two spaced downward extending bottom lugs, a bar being across the lugs;

wherein the outer hooked end of each link is pivotably coupled to the bar, wherein each of the intermediate joints further comprises a recess between the lugs; and, wherein each recess has a length longer than that of the lugs;

wherein the bar is integrally formed with the lugs; and wherein the bar is disposed at a position less than half of the projected distance of the lug relative to a bottom of the intermediate joints;

wherein the link is made of stainless steel; and wherein the outer hooked end of each link is disposed around more than half of a circumference of the bar.

2. The frame of claim 1, wherein the recess is in communication with the central through hole and the outer hooked end of each link is sufficiently smaller than the recess so that the ribs are spaced apart from the spreaders by a substantially zero distance when the umbrella is folded.

* * * * *